US008187527B2

(12) United States Patent
Tyl

(10) Patent No.: US 8,187,527 B2
(45) Date of Patent: May 29, 2012

(54) ENERGY EFFICIENT MODULAR GAS FLUIDIZED SAND HEAT TREATING APPARATUS AND SAND RETURN SYSTEM

(76) Inventor: Thomas Wilson Tyl, Siler City, NC (US)

( * ) Notice: Subject to any disclaimer, the term of this patent is extended or adjusted under 35 U.S.C. 154(b) by 803 days.

(21) Appl. No.: 12/205,906

(22) Filed: Sep. 7, 2008

(65) Prior Publication Data

US 2010/0059148 A1 Mar. 11, 2010

(51) Int. Cl.
*C22B 5/14* (2006.01)

(52) U.S. Cl. ..... 266/172; 266/265; 148/559

(58) Field of Classification Search ..... 266/172, 266/251, 252, 265, 274; 148/698, 559; 432/58, 432/15

See application file for complete search history.

(56) References Cited

U.S. PATENT DOCUMENTS 4,578,879 A * 4/1986 Yokoyama et al. ..... 34/582
4,730,811 A * 3/1988 Hattori et al. ..... 266/81
4,758,154 A 7/1988 Branders
6,042,369 A * 3/2000 Bergman et al. ..... 432/15
7,025,927 B2 * 4/2006 Sakai ..... 266/172

* cited by examiner

*Primary Examiner* — Scott Kastler
*Assistant Examiner* — Michael Aboagye
(74) *Attorney, Agent, or Firm* — George R. Reardon

(57) ABSTRACT

A modular air fluidized sand bed for the heat treatment of metal products is disclosed. This technology provides for the heat-treatment of steels, particularly long products, and other alloys and shapes using fluidized-sand heat transfer media. The technology directs gas burners into U-tube assemblies suspended in the media. The fluidizing agent is hot exhaust gas recovered from the U-tubes. Blended exhaust gases and cool air can maintain fluidizing gas, plenum and retort temperatures at nearly the same temperature as the sand. Constant volume and pressure of fluidizing gas maximizes heat transfer between sand and product. For extreme heating applications, a thermally insulated cover held in direct contact with the hot fluidized sand improves energy efficiency. A sand return system returns sand lost from the bed exit to entrance. The modular air fluidized sand bed includes a fluidization pressure and volume that are altered independent of a fluidization media temperature.

14 Claims, 23 Drawing Sheets

ENERGY EFFICIENT MODULAR GAS FLUIDIZED SAND HEAT TREATING APPARATUS AND SAND RETURN SYSTEM

FIELD OF THE INVENTION

The technology described herein relates generally to the treatment of metal products utilizing a fluidization process. More specifically, this technology relates to systems and methods for energy efficient modular gas fluidized sand heat treating and a sand return system and method.

BACKGROUND OF THE INVENTION

Fluidization beds can be utilized for the heat treatment and processing of metal products such as steels and alloys. Fluidization converts a static solid state granular material such as sand into a dynamic fluid state by introducing a gas flow from a bottom of the bed of sand. At a point where the gas flow velocity introduced from the bottom of the sand bed and the force of gravity reach an equilibrium state, fluidization is achieved. Once fluidized the bed of sand behaves generally as a fluid and is useful in various manufacturing and treatment processes such as the heat treatment of metal products.

Related patents known in the art include the following. U.S. Pat. No. 4,758,154, issued to Branders on Jul. 19, 1988, discloses a fluidized-bed plant.

The foregoing patent and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides for the heat-treatment of steels, particularly long products, and other alloys and shapes using fluidized-sand heat transfer media. The technology directs gas burners into U-tube assemblies suspended in the media. The fluidizing agent is hot exhaust gas recovered from the U-tubes. When necessary, blended exhaust gases and cool air maintain fluidizing gas, plenum and retort temperatures at nearly the same temperature as the sand. Constant volume and pressure of fluidizing gas maximizes heat transfer between sand and product. For extreme heating applications, a thermally insulated cover held in direct contact with the hot fluidized sand improves the unit's energy efficiency. A sand return system returns sand lost from the bed exit to entrance.

In one exemplary embodiment, the technology described herein provides a modular air fluidized sand bed for the heat treatment of metal products. The modular air fluidized sand bed includes a plurality of gas-fired burners directed into a plurality of U-tube assemblies in a fluidized-sand heat transfer media heated by a fluidizing agent and exhausted into a plenum of a modular air fluidized sand bed, the modular air fluidized sand bed having a fluidization pressure and a fluidization volume that selectively are altered independent of a fluidization media temperature, an independent control module to alter temperature, an independent control module to alter fluidization pressure, and an independent control module to alter fluidization volume. The fluidizing agent is hot exhaust gas recovered from the plurality of U-tube assemblies. Blended exhaust gases and cool air from a cool air source maintain fluidizing gas, plenum, and retort temperatures at generally a same temperature as the sand. A constant volume and pressure of fluidizing gas is utilized to maximize heat transfer between sand and a product being treated in the modular air fluidized sand bed.

The modular air fluidized sand bed also includes a thermally insulated fluidization cover to be held in direct contact with the hot fluidized sand to improve the energy efficiency of the modular air fluidized sand bed.

The modular air fluidized sand bed also includes a high-pressure air source to assist a start of a fluidization process when a fluidization media is cool.

The modular air fluidized sand bed also includes an exhaust manifold assembly to capture and route exhaust from the gas-fired burners directed into a plurality of U-tube assemblies from the U-tube assemblies to one of into a retort above a sand level and through a hood. The exhaust manifold assembly includes a U-tube exhaust manifold and a venting line disposed upon the U-tube exhaust manifold to vent the exhaust. The exhaust manifold assembly includes a first pressure transducer to control pressure in the U-tube exhaust manifold and a valve controlled by the pressure transducer and configured to vent exhaust. An exhaust gas pressure in the U-tube exhaust manifold is held constant through utilization of the pressure transducer and valve. The exhaust manifold assembly includes a cool air manifold to contain cool air for blending with the U-tube exhaust manifold gas in order to reduce a temperature in the plenum. The exhaust manifold assembly includes a thermocouple disposed within the plenum to monitor and control temperature, a first blending valve controlled by the thermocouple disposed within the plenum and configured to release gas from the U-tube exhaust manifold to blend with gas from the cool air manifold, and a second blending valve controlled by the thermocouple disposed within the plenum and configured to release gas from the cool air manifold to blend with gas from the U-tube exhaust manifold. It is desired to have the same temperature in the plenum as a temperature of the fluidized sand in the modular air fluidized sand bed. The exhaust manifold assembly includes a second pressure transducer disposed with the cool air manifold and configured to control pressure in the cool air manifold and a third pressure transducer disposed with the plenum and configured to control pressure in the plenum. The pressure in the cool air manifold and the pressure in the exhaust manifold are maintained at the same pressure to facilitate blending.

The modular air fluidized sand bed also includes a sand return assembly having fluidization nozzles to return sand lost from an exit of the modular air fluidized sand bed to an entrance of the modular air fluidized sand bed utilizing fluidization and gravity to move a fluidization media. The sand return assembly further includes a sand dam assembly to contain sand for return in the sand return assembly, a sand hopper assembly to maintain a sand level within the modular air fluidized sand bed, a fluidization air supply, and a plurality of fluidization nozzles disposed on an underside of the sand hopper assembly and the sand dam assembly.

In another exemplary embodiment, the technology described herein provides a modular fluidized bed containment assembly. The containment assembly includes a plurality air fluidized sand bed modules for the heat treatment of metal products maintained and controlled in a plurality of independent zones and an insulated containment system surrounding the plurality of air fluidized sand bed modules to increase energy efficiency. The containment assembly also includes a thermally insulated fluidization cover to be selectively raised and lowered above the fluidized bed and held in direct contact with the hot fluidized sand to improve the energy efficiency of the plurality air fluidized sand bed modules. The containment assembly further includes a plurality of stack heat exchangers disposed above the plurality air fluidized sand bed modules and a heating air exhaust exiting from the plurality of stack heat exchangers to enable use of heating air in other locations.

In yet another exemplary embodiment, the technology described herein provides a method for the heat treatment of metal products. The method includes utilizing a plurality of air fluidized sand bed modules each having a plurality of gas-fired burners directed into a plurality of U-tube assemblies in a fluidized-sand heat transfer media heated by a fluidizing agent and exhausted into a plenum of each air fluidized sand bed module, each air fluidized sand bed module having a fluidization pressure and a fluidization volume that selectively are altered independent of a fluidization media temperature; an independent control module to alter temperature, an independent control module to alter fluidization pressure, and an independent control module to alter fluidization volume and selectively controlling temperature, fluidization pressure, and fluidization volume independently. The method also includes utilizing a plurality of air fluidized sand bed modules each further comprising an exhaust manifold and a cool air manifold and selectively mixing exhaust gases with cool air to maintain a desired plenum and fluidization gas temperature. The method further includes utilizing a plurality of air fluidized sand bed modules in combination with a sand return assembly having fluidization nozzles and returning sand lost from an exit of the air fluidized sand bed module to an entrance of the air fluidized sand bed module utilizing fluidization and gravity to move a fluidization media.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Figure 1:
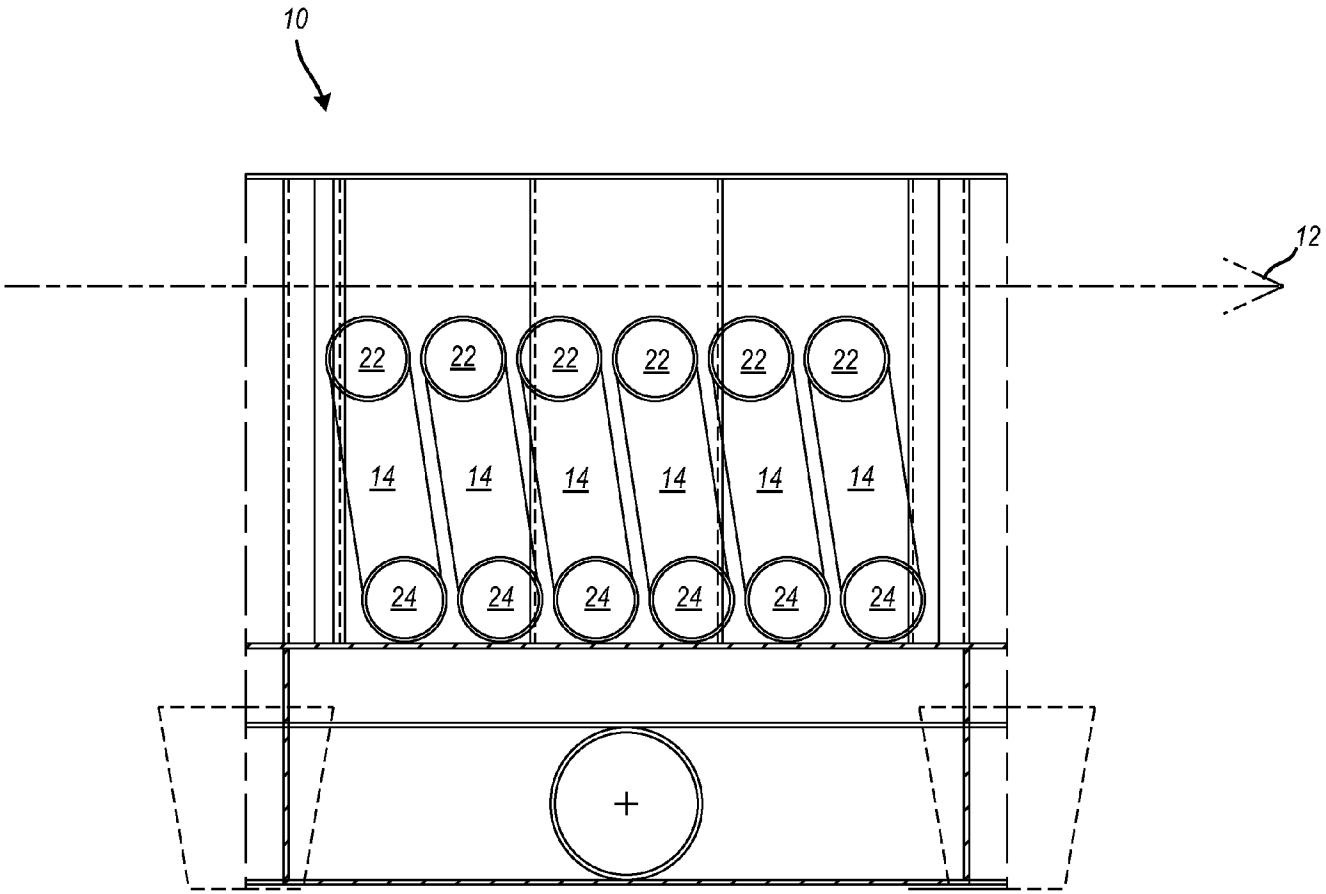
FIG. 1 is an end view schematic diagram of a modular air fluidized sand bed.

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides for the heat-treatment of steels, particularly long products, and other alloys and shapes using fluidized-sand heat transfer media. The technology directs gas burners into U-tube assemblies suspended in the media. The fluidizing agent is hot exhaust gas recovered from the U-tubes. When necessary, blended exhaust gases and cool air maintain fluidizing gas, plenum and retort temperatures at nearly the same temperature as the sand. Constant volume and pressure of fluidizing gas maximizes heat transfer between sand and product. For extreme heating applications, a thermally insulated cover held in direct contact with the hot fluidized sand improves the unit's energy efficiency. A sand return system returns sand lost from the bed exit to entrance.

As will be appreciated by those skilled in the art, alternative embodiments can be utilized to provide heat in addition to the gas-fired burners of the illustrative embodiment. For example, in one alternative embodiment, electric heaters can be utilized.

This technology provides greater energy efficiency than known fluidized beds. The design is modular to help reduce manufacturing costs. Complete units are comprised of one or more identical modules utilized together. Each module is independently controllable for temperature, fluidization pressure and fluidization volume, greatly increasing the unit's versatility.

In some applications, such as strand patenting, for example, the first module cools the product from the austenitizing temperature to the desired soaking temperature. In this case, high volume, high velocity, cool air blows through some or all of the U-tube assemblies and cool air fluidizes the first module. In extreme cooling applications, a water stream or mist, directed at the top of all or a section of the hot fluidizing media of the first module assists cooling by water evaporation. This first module design allows changing the cooling length during operation from all, or only a portion of, the first module as required by product property specifications. When the unit is idled or stopped for reasons like maintenance, first module temperature reaches normal levels by igniting burners in the U-tubes and fluidizing the first module with hot exhaust gases recovered from the U-tubes.

The fluidization volume and pressure are independent of the fluidizing media temperature, allowing optimization of media fluidization for maximum heat transfer between media and product regardless of media temperature. The technology incorporates a low maintenance sand return system utilizing fluidizing air to move sand down an inclined, pipe-like assembly without metal elbows or bends. When maximum energy efficiency is required, like in strand wire tempering for bead wire applications, a uniquely shaped insulated fluidization cover lays directly on the fluidization media trapping waste heat in the fluidization media for transfer to the product. In some cases, an air-to-air or air-to-water heat exchanger installed in the unit's hood stack captures waste heat for mild heating application like wire drying or liquid bath heating. To assist starting fluidization when the fluidizing media is cool, for example below 250 degrees Celsius, high-pressure factory air introduced into the plenum assures fluidization until the media reaches a suitable, sustainable fluidization temperature In operation, the technology provides that heat is transferred from the media to the product or product to the media in the direction of lower temperature. The technology consists of an inner retort with a plenum on the bottom to distribute fluidization gasses uniformly throughout the entire unit. The inner retort can be comprised of modular sections each independently controlled or one non-modular section capable of "zone" control. Control means independent control of fluidization media temperature, fluidization pressure and fluidization volume. The retort is contained in an outer shell that is insulated from the retort to maintain a low shell temperature and high-energy efficiency. The retort is free to move inside the shell to accommodate thermal expansion. The shell is covered with a hood that directs used fluidization gasses to a stack generally containing a heat exchanger to scavenge waste heat. The fluidization media is heated using U-tube burners that exhaust into the plenum for fluidization purposes. Exhaust gasses can be mixed in the plenum with cool air to prevent overheating and maintain a temperature similar to the desired media temperature for uniform thermal expansion. A uniquely shaped insulated fluidization cover laying directly on the fluidization media traps waste heat in the fluidization media for transfer to the product and greatly increasing energy efficiency. The cover's shape precludes fluidization media build-up on the cover. For strand operations, a unique media return system utilizes fluidization technology and gravity rather than blown air to move media from the unit's exit to entrance. Some blown air is utilized in the media return system to lift fluidization media slightly higher than the normal fluidization height and in this case, an easily replaceable, long life flat plate is provided for sacrificial abrasion. Returned media is precisely placed at the retort entrance to help isolate the product from room air.

Figure 2:
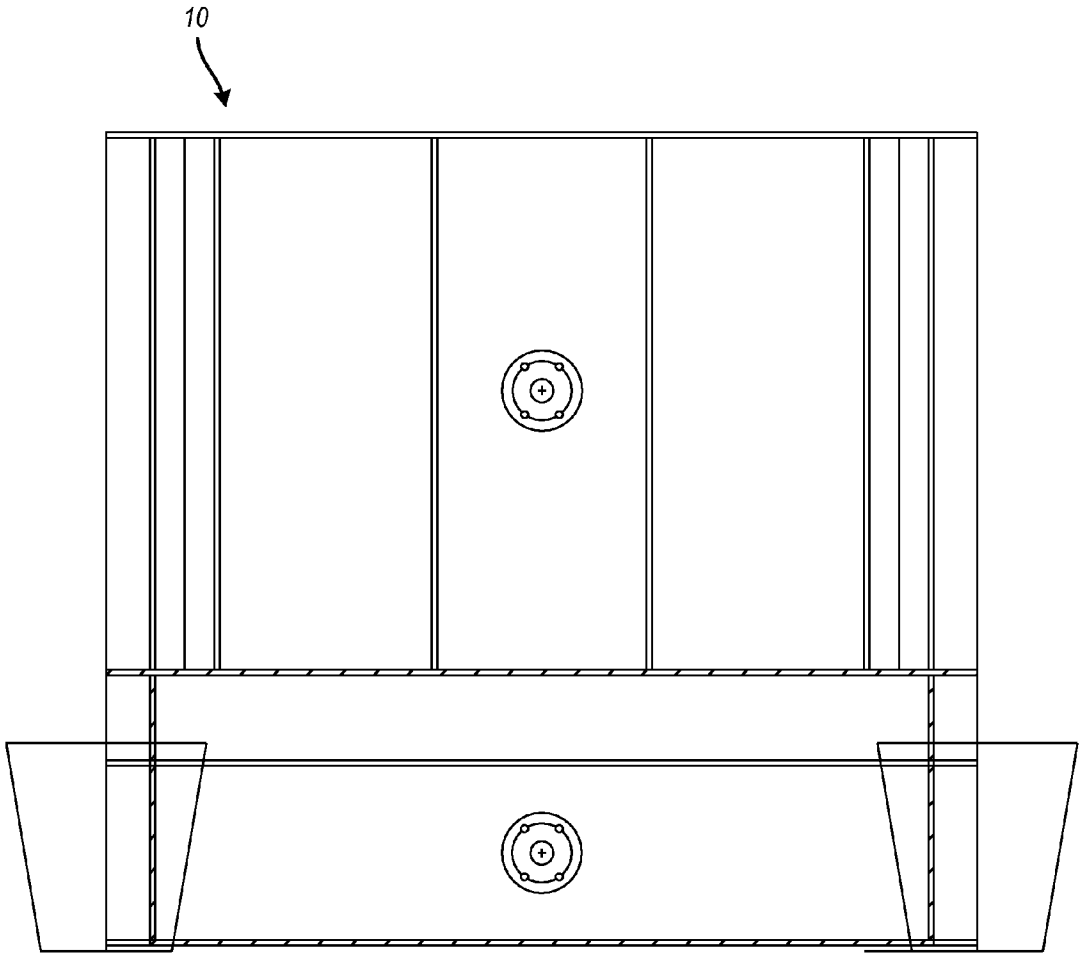
FIG. 2 is an end view (opposite that of FIG. 1) schematic diagram of a modular air fluidized sand bed.
Figure 3:
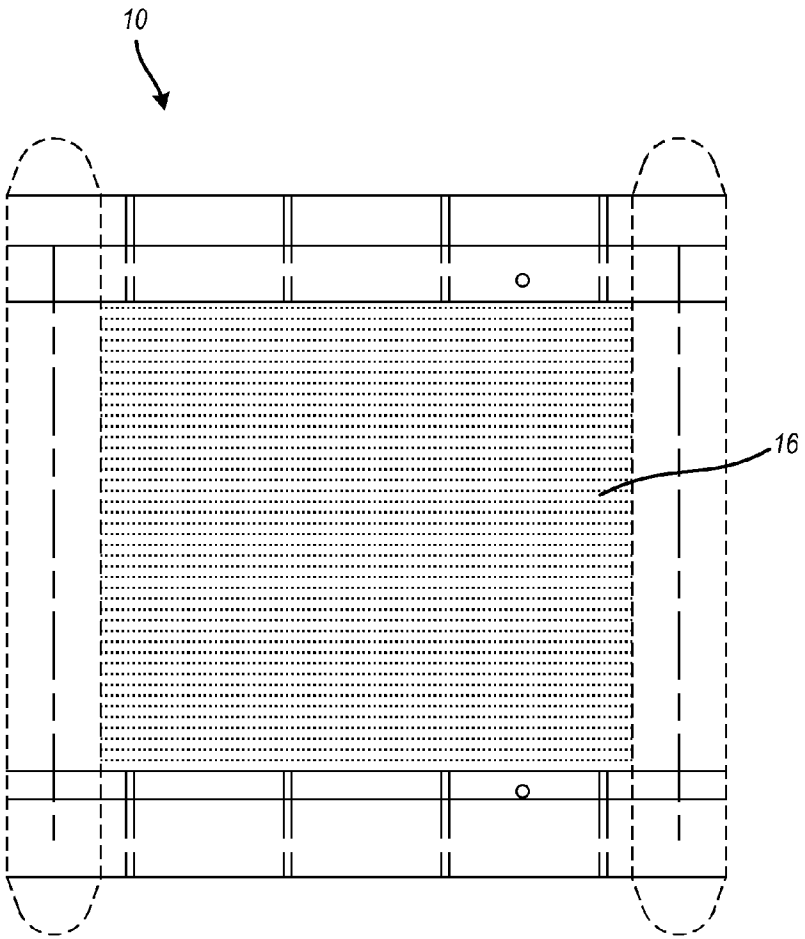
FIG. 3 is a top view schematic diagram of a modular air fluidized sand bed, illustrating, in particular, the fluidized sand bed.
Figure 4:
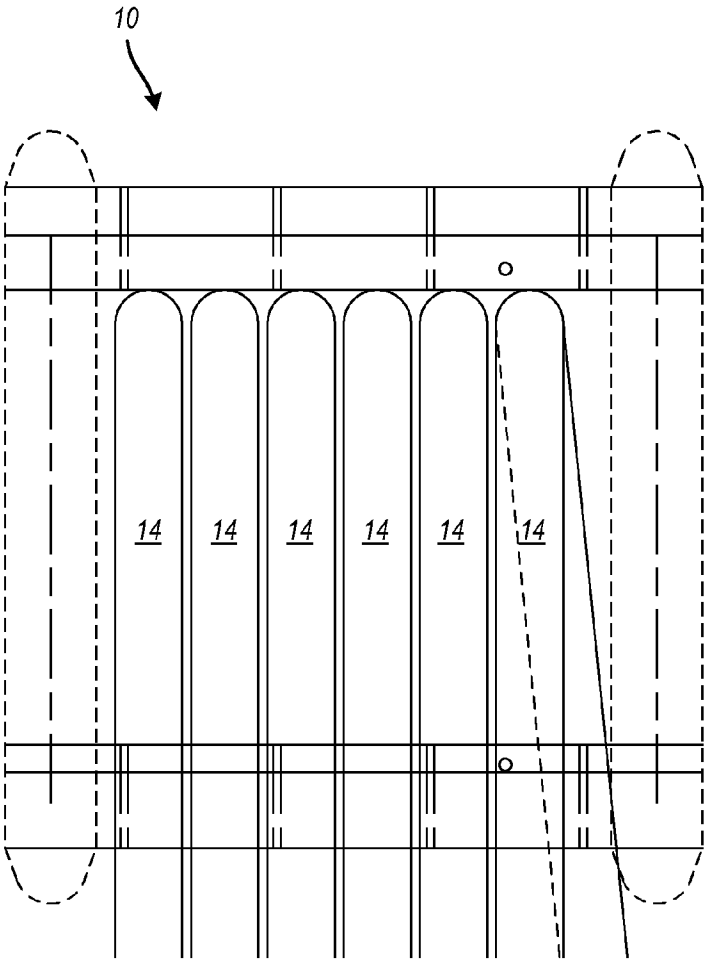
FIG. 4 is a top view schematic diagram of a modular air fluidized sand bed, illustrating, in particular, a multiplicity of U-tube burners.

Referring now to FIGS. 1, 2, 3 and 4, a modular air fluidized sand bed 10 is shown. FIGS. 1 and 2 illustrate the modular air fluidized sand bed 10 from opposite ends. FIG. 3 illustrates the modular air fluidized sand bed 10 from a top view showing the fluidized sand bed 16. FIG. 4 illustrates the modular air fluidized sand bed 10 from a top view showing the U-tube burners 14. In at least one alternative embodiment electric heaters can be utilized instead of the gas-fired burners. The modular air fluidized sand bed 10 includes gas-fired burners directed into a plurality of U-tube assemblies 14 (or simply referred to as U-tube burners 14) in a fluidized-sand heat transfer media heated by a fluidizing agent and exhausted into a plenum of the modular air fluidized sand bed. The U-tube burners 14 each include a burner inlet 22 and a burner exhaust 24. The modular air fluidized sand bed 10 is utilized in the heat-treatment of steels, particularly long products, and other alloys and shapes using fluidized-sand heat transfer media. Throughout the figures, the modular air fluidized sand bed 10 is shown in use with in a strand wire application as an example. It will be apparent to those in the art that the modular air fluidized sand bed 10 can be utilized in other applications. The directional path of the wire flow is shown by arrow 12. The wire path 12 must be above the highest portion of the U-tube assemblies 14 and not between the bends of the U-tube assemblies 14 or below the U-tube assemblies 14. Disposed within the modular air fluidized sand bed 10 is fluidized bed 16 (as depicted specifically in FIG. 3). The fluidized bed 16 includes a granular material, such as, for example but not limited to, 300 to 350 cubic feet of sand that is fluidized.

Figure 5:
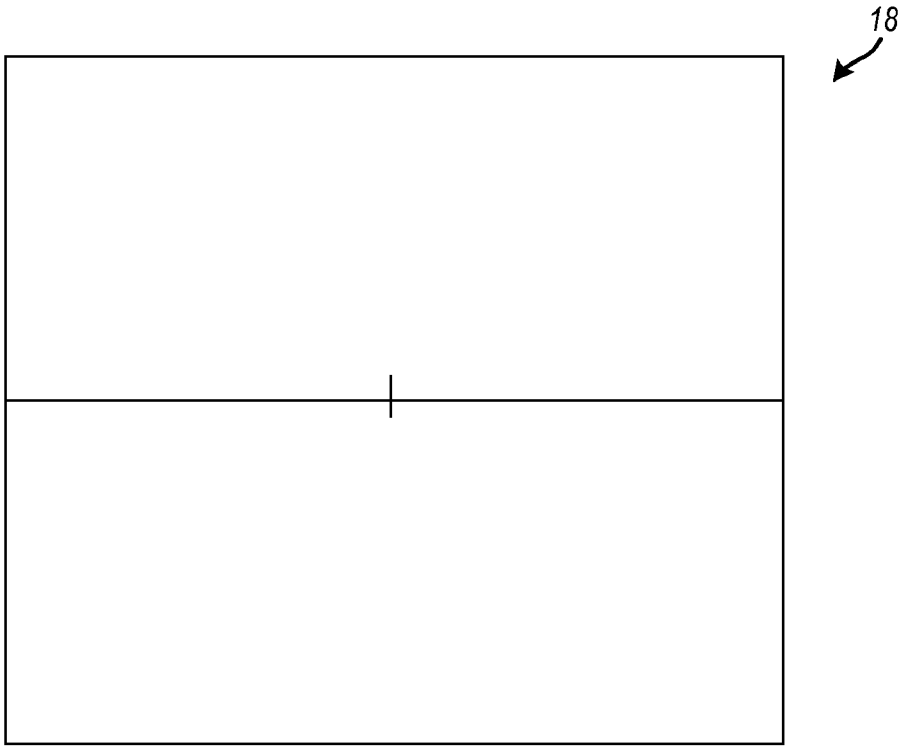
FIG. 5 is a top view schematic diagram of an insulated fluidization cover.
Figure 6:
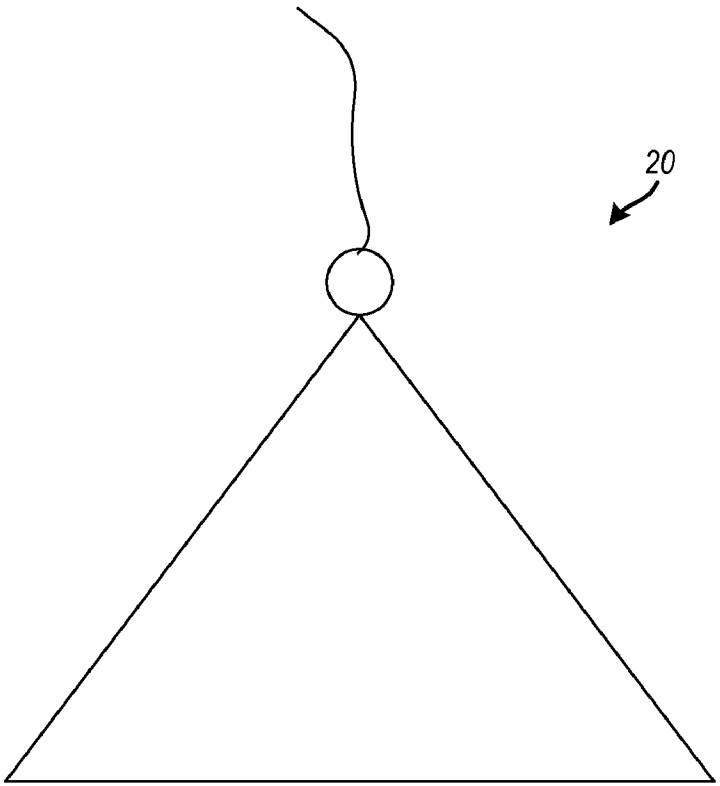
FIG. 6 is a side view schematic diagram of the mechanism to raise and lower the insulated fluidization cover over the fluidized bed.

Referring now to FIGS. 5 and 6, an insulated fluidization cover 18 and a mechanism 20 to raise and lower the insulated fluidization cover over the fluidized bed are shown. The insulated fluidization cover 18 utilizes a novel shape and lays directly over the fluidization media to trap waste heat in the fluidization media for transfer of the product. Use of insulated fluidization cover 18 increases the energy efficiency of the modular air fluidized sand bed 10.

Figure 7:
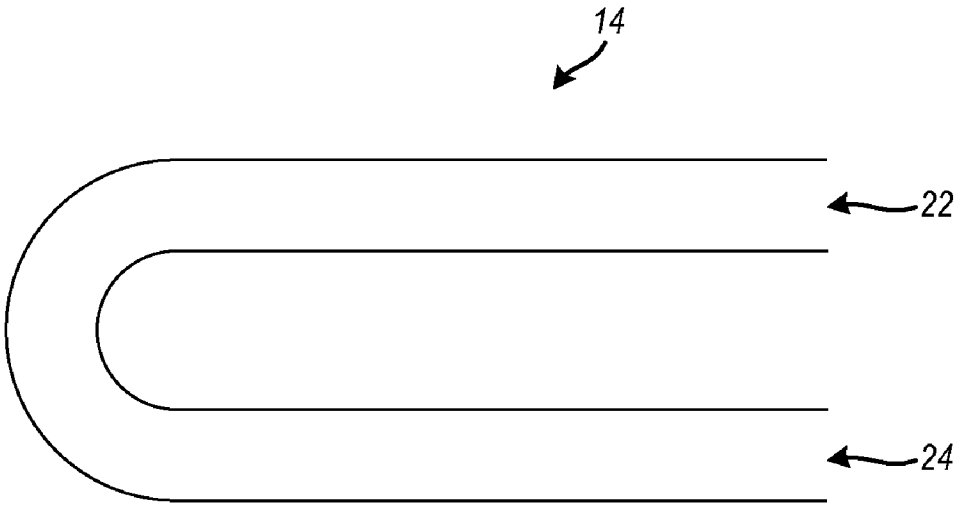
FIG. 7 is a side view of a U-tube burner used in the modular air fluidized sand bed.
Figure 8:
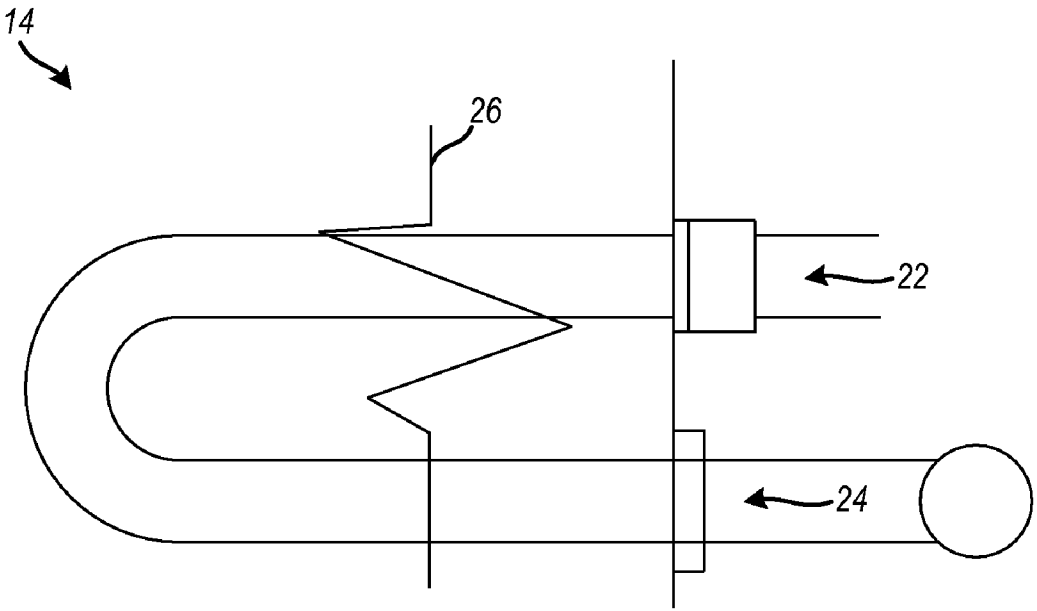
FIG. 8 is a side view of an exhaust manifold rod assembly on a U-tube burner.

Referring now to FIGS. 7 and 8, a U-tube burner 14 is shown. The U-tube burners 14 each include a burner inlet 22 and a burner exhaust 24. As part of the overall exhaust manifold assembly each U-tube burner 14 includes an exhaust manifold rod 26.

Figure 9:
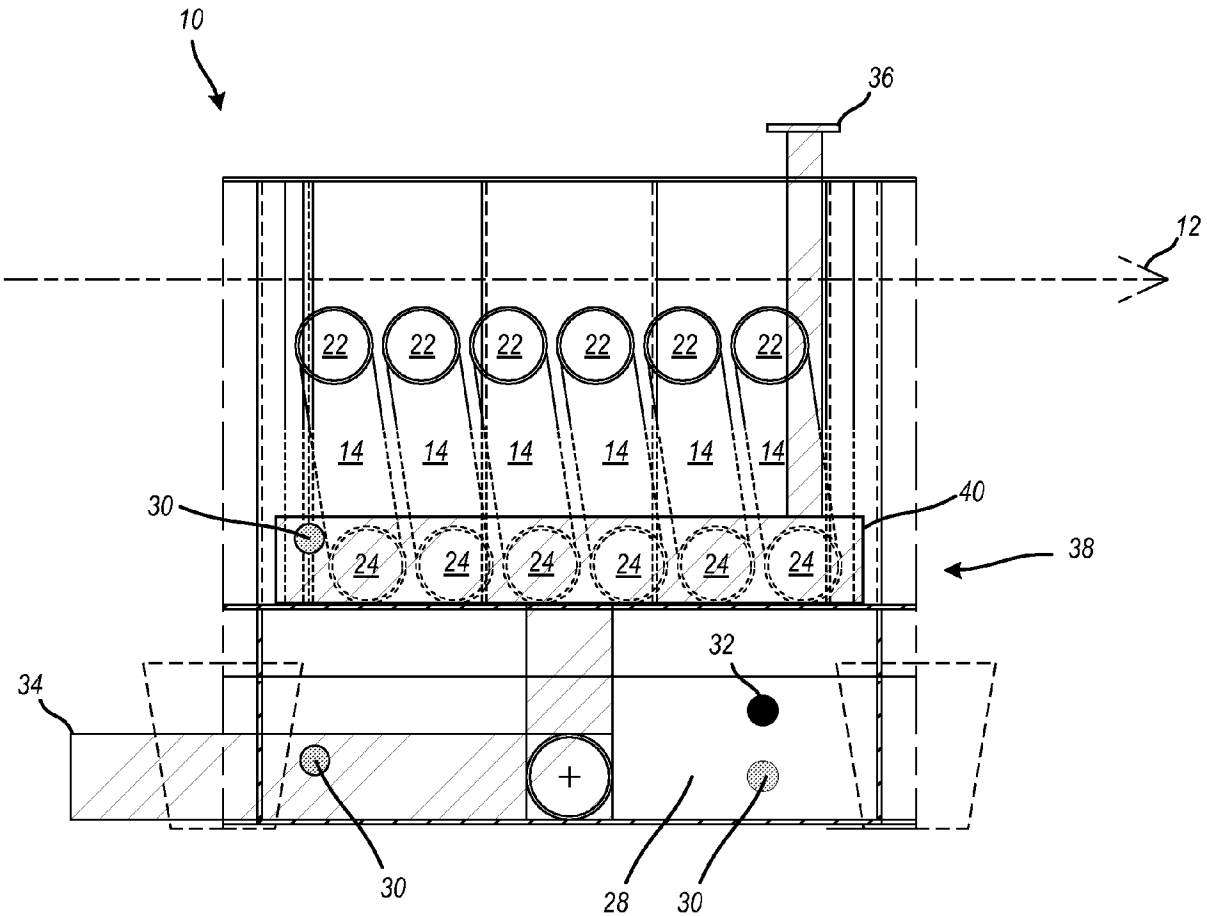
FIG. 9 is the end view (non working end) schematic diagram of a modular air fluidized sand bed with an exhaust manifold.
Figure 10:
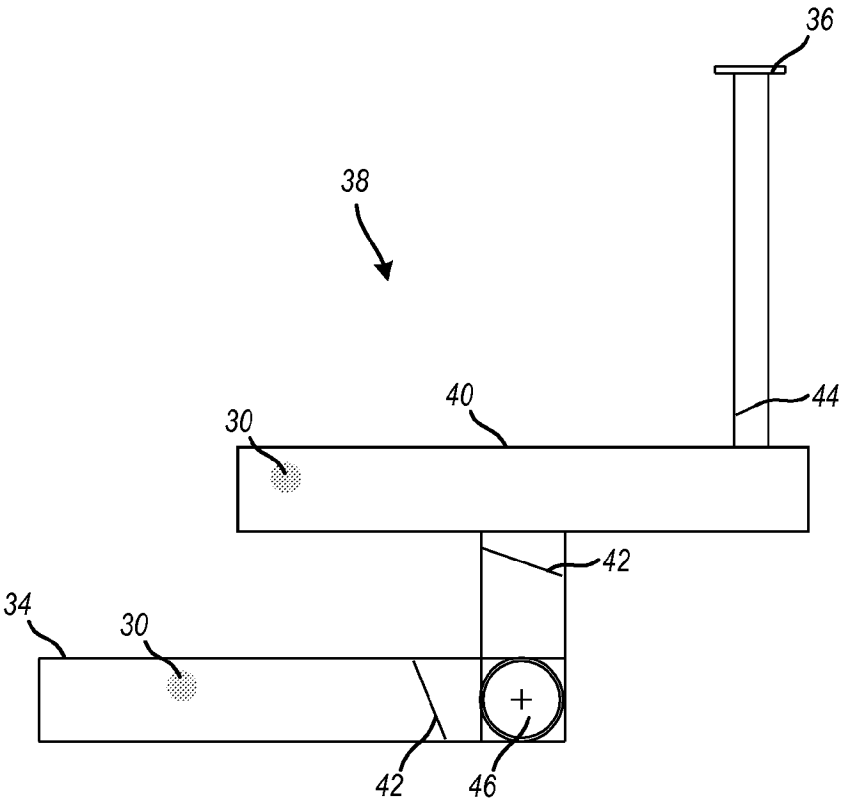
FIG. 10 is a side view schematic diagram of the exhaust manifold.
Figure 11:
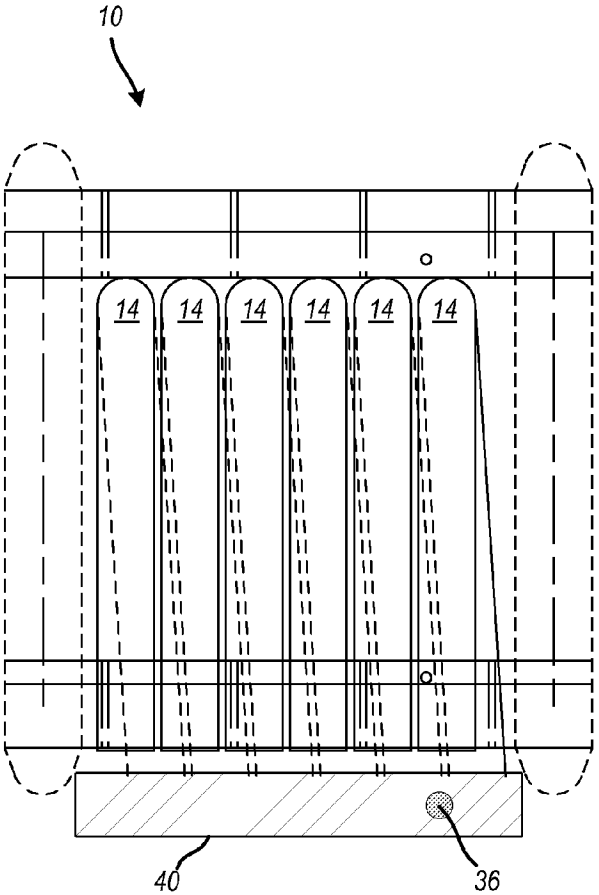
FIG. 11 is a top view schematic diagram of the modular air fluidized sand bed with an exhaust manifold.

Referring now to FIGS. 9, 10, and 11, the exhaust manifold assembly 38 is shown. The exhaust manifold assembly 38 is utilized to direct exhaust gas exiting from the U-tube burners 14 for recovery and subsequent use as a fluidizing agent in the modular air fluidized sand bed 10. The exhaust manifold assembly 38 is shown overlain on the modular air fluidized sand bed 10 depicted in FIG. 1.

The exhaust manifold assembly 38 includes a U-tube exhaust manifold 40 and a venting line 36 for the U-tube exhaust manifold 40. Venting line 36 includes a hole entering the retort above the sand level or into the hood. The U-tube exhaust manifold 40 captures exhaust gas exiting from the burner exhaust 24 of all of the U-tube burners 14 for use as a fluidizing agent in the modular air fluidized sand bed 10.

The exhaust manifold assembly 38 also includes the use of pressure transducers 30. One pressure transducer 30, located within the U-tube exhaust manifold 40, is utilized to control pressure within the U-tube exhaust manifold 40. The exhaust manifold assembly 38 also includes a valve 44 controlled by the pressure transducer 30 within the U-tube exhaust manifold 40. The valve 44 is configured to vent exhaust as necessary. Utilization of the exhaust manifold assembly 38 in this manner provides for an exhaust gas pressure in the U-tube exhaust manifold 40 to be held constant through utilization of the pressure transducer 30 and valve 44. A pressure transducer 30 is also located within the plenum 28.

The exhaust manifold assembly 38 further includes a cool air manifold 34 to contain cool air for blending with the gas from U-tube exhaust manifold 40 in order to reduce a temperature in the plenum 28. It is desired to have the same temperature in the plenum 28 as a temperature of the fluidized sand in the modular air fluidized sand bed 10. A thermocouple 32 is disposed within the plenum 28 to monitor and control temperature in the plenum 28. Blending valves 42 are utilized to release gas selectively to attain the same temperature in the plenum 28 as a temperature of the fluidized sand in the modular air fluidized sand bed 10.

One blending valve 42 is located between the U-tube exhaust manifold 40 and pipe 46 connected to plenum 28 and is controlled by the thermocouple 32 disposed within the plenum 28 and configured to release gas from the U-tube exhaust manifold 40 to blend with gas from the cool air manifold 34. Another blending valve 42 is located between the cool air manifold 34 and pipe 46 connected to plenum 28 and is controlled by the thermocouple 32 disposed within the plenum 28 and configured to release gas from the cool air manifold 34 to blend with gas from the U-tube exhaust manifold 40.

It also is desired that the pressure in the cool air manifold 34 and the pressure in the U-tube exhaust manifold 40 are maintained at the same pressure to facilitate blending. A pressure transducer 30 is disposed within the cool air manifold 34 and configured to control pressure in the cool air manifold 34. A pressure transducer 30 is disposed with the plenum 28 and configured to control pressure in the plenum 28. The exhaust gas pressure must be held constant, so some of the exhaust can be vented into the retort or through the hood to reduce pressure in the exhaust manifold assembly 38.

Figure 12:
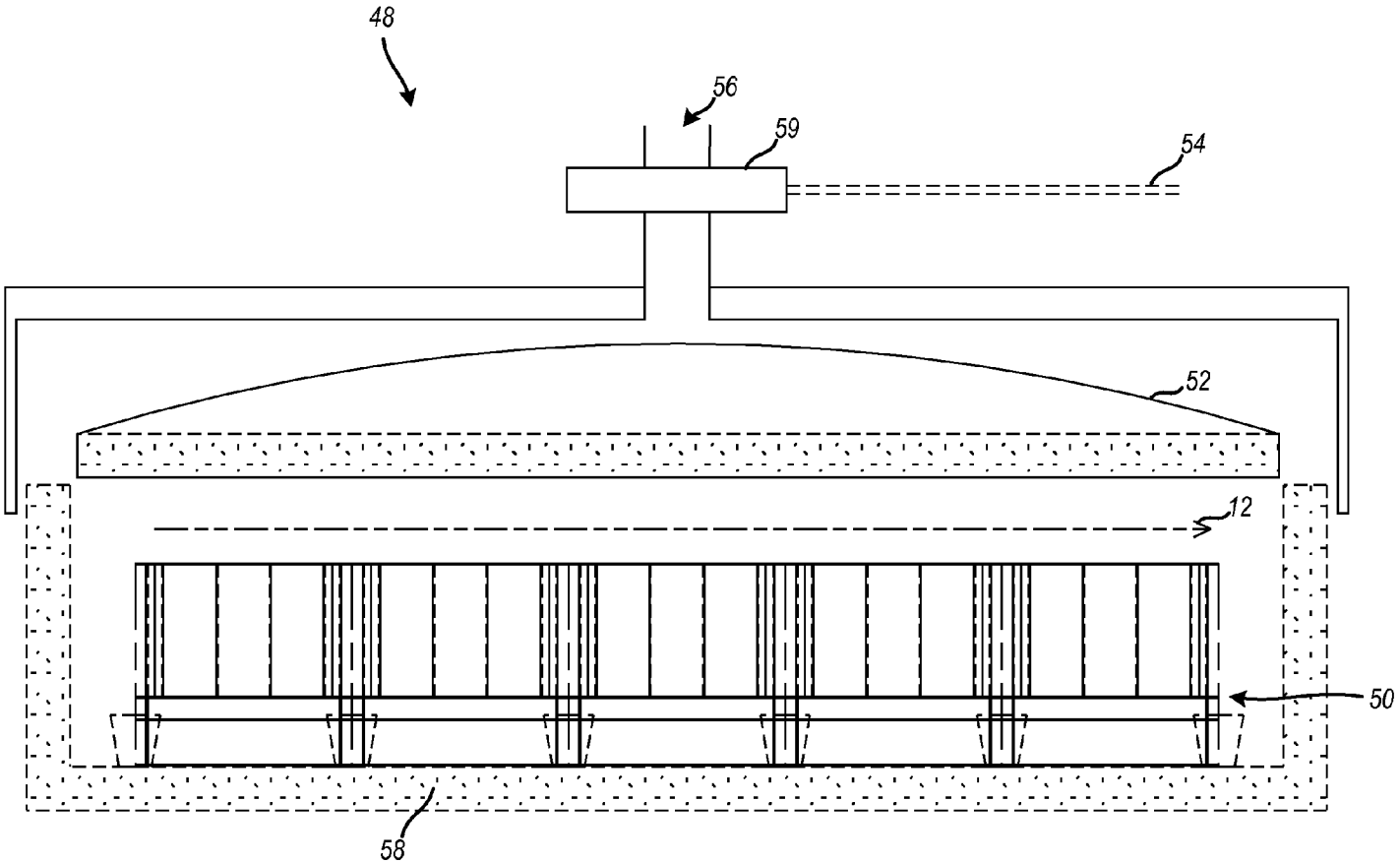
FIG. 12 is a side view schematic diagram of a modular air fluidized sand bed containment assembly.
Figure 13:
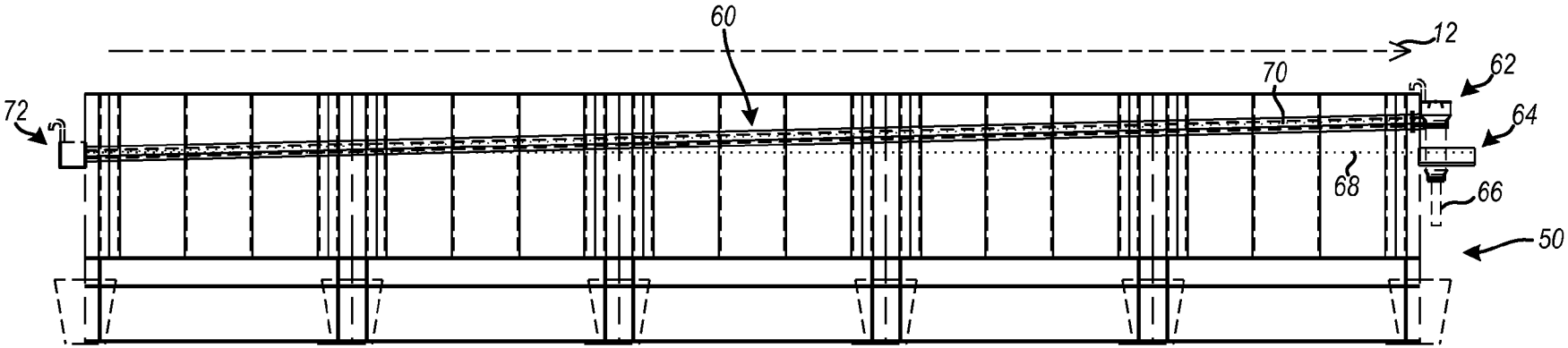
FIG. 13 is a side view schematic diagram of a sand return assembly with modular air fluidized sand bed assembly.

Referring now to FIG. 12, a modular air fluidized sand bed containment assembly 48 is shown. The containment assembly 48 includes a fluidized bed assembly 50 having a plurality air fluidized sand bed modules 10 for the heat treatment of metal products to be maintained and controlled in a plurality of independent zones and an insulated containment system 58 surrounding the plurality of air fluidized sand bed modules 10 to increase energy efficiency. Wire path 12 illustrates the direction of wire flow through the fluidized bed assembly 50.

The containment assembly 48 includes a thermally insulated fluidization cover 52 to be selectively raised and lowered above the fluidized bed assembly 50 and held in direct contact with the hot fluidized sand to improve the energy efficiency of the air fluidized sand bed modules 10.

The containment assembly 48 includes stack heat exchangers 59 disposed above the plurality air fluidized sand bed modules 10 and thermally insulated fluidization cover 52 to process exhaust 56. The heating air exhaust 54 exiting from the plurality of stack heat exchangers 59 enables use of heating air in other locations.

Referring now to FIGS. 13, 14, 15, 16, 17, and 18, a sand return assembly 60 is shown. The sand return assembly 60 is utilized in conjunction with the modular air fluidized sand bed 10, or collectively as a fluidized bed assembly 50, to return sand lost from an exit of the modular air fluidized sand bed 10 to an entrance of the modular air fluidized sand bed 10 utilizing fluidization and gravity to move a fluidization media. Wire path 12 is shown to illustrate the direction of wire flow through the fluidized bed assembly 50.

The sand return assembly 60 includes an air pressure release assembly 62, a sand hopper assembly 64 having a sand return air supply 66, and a sand dam assembly 72. The sand return assembly 60 utilizes fluidization nozzles 84 on an underside of the sand hopper assembly 64 and the sand dam assembly 72. Sand levels 68 and 70 are shown. Sand level 68 is the sand level within the fluidized bed assembly 50 and the sand hopper assembly 64. Sand level 70 is the sand level within sand return assembly 60.

Figure 14:
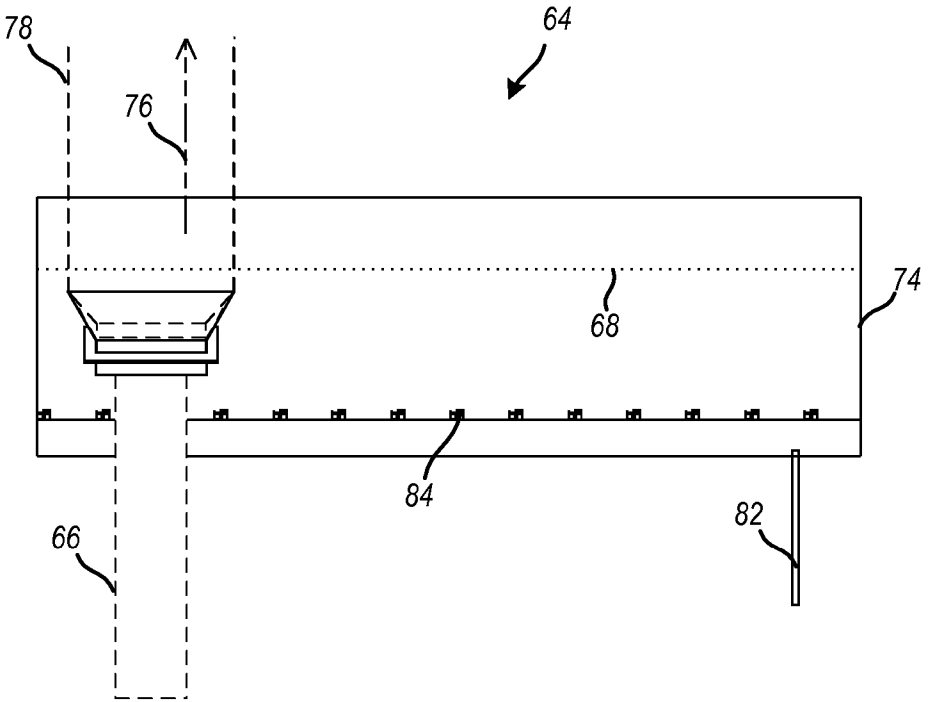
FIG. 14 is a side view schematic diagram of a sand hopper assembly of the sand return assembly.

As depicted specifically in FIG. 14, the sand hopper assembly 64 maintains a sand level 68 within the fluidized bed assembly 50. The sand hopper assembly 64 includes a sand return air supply 66 to facilitate the flow of sand, a sand hopper 74 to contain sand, and a sand transfer pipe 78 to route the sand in the direction of arrow 76. Fluidization nozzles 84 are disposed along an inside bottom surface in the sand hopper assembly 64 and activated by fluidization air supply 82.

Figure 15:
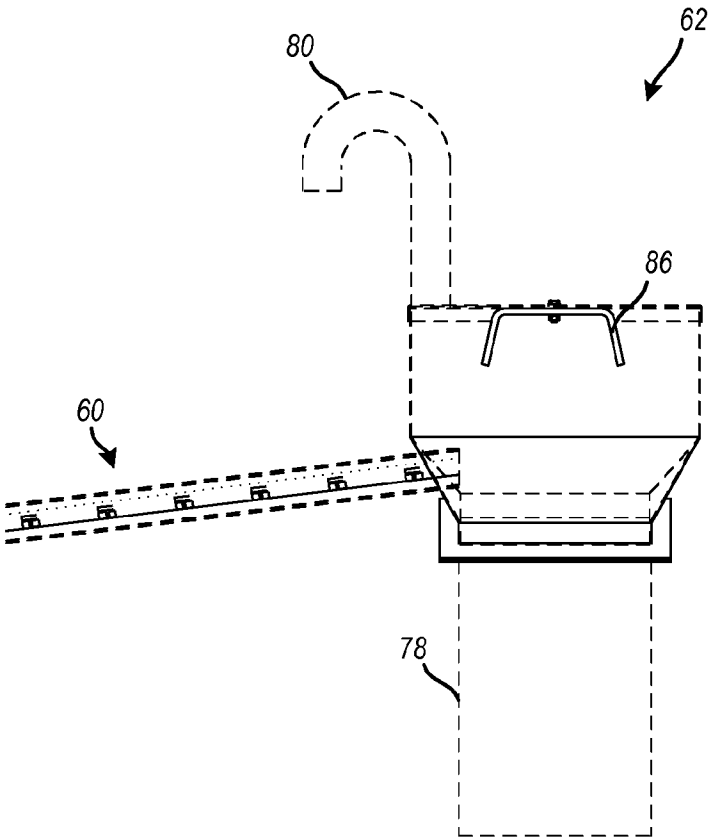
FIG. 15 is a side view schematic diagram of an air pressure release assembly of the sand return assembly.

As depicted specifically in FIG. 15, the air pressure release assembly 62 is shown. The air pressure release assembly 62 includes an air release 80. The air pressure release assembly 62 interconnects with the sand deflection assembly 86, sand transfer pipe 78, and sand return assembly 60.

Figure 16:
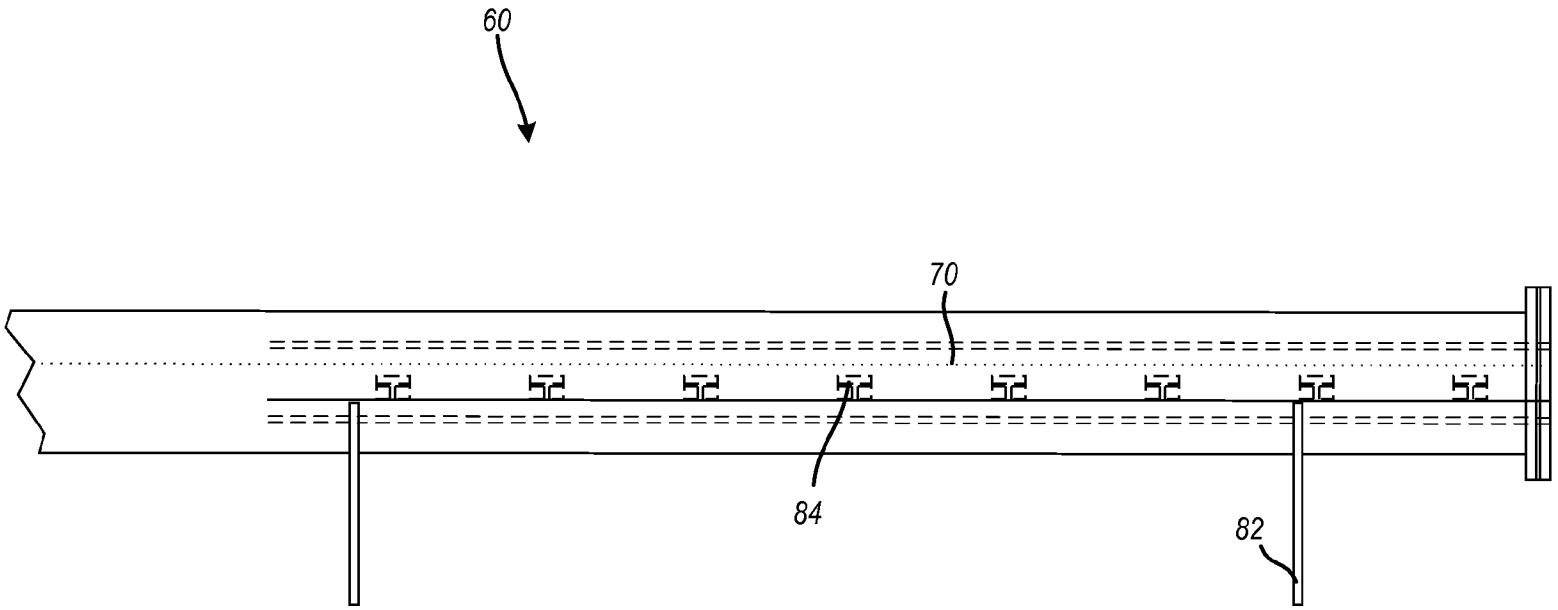
FIG. 16 is a side view schematic diagram of a sand return assembly.

As depicted specifically in FIG. 16, a side view of sand return assembly 60 is shown. The sand within the sand return assembly 60 is fluidized by the multiplicity of fluidization nozzles 84 fed by fluidization air supply 82. The fluidization nozzles 84 are maintained below sand level 70.

Figure 17:
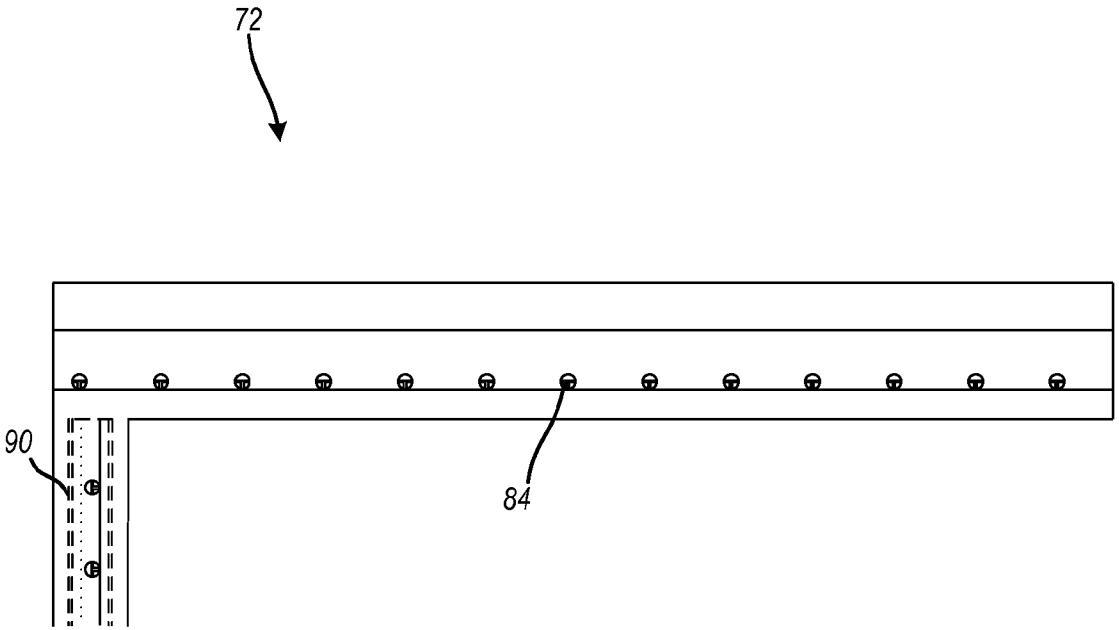
FIG. 17 is a top view schematic diagram of a sand dam assembly.
Figure 18:
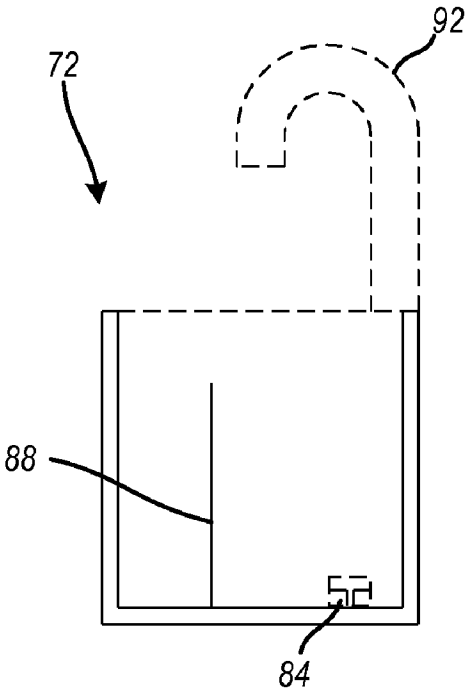
FIG. 18 is a side view schematic diagram of a sand dam assembly

As depicted specifically in FIGS. 17 and 18, a sand dam assembly 72 is shown. The sand dam assembly 72 contains sand for return in the sand return assembly 60. The sand dam assembly 72 includes a sand dam 88, a sand dam air release 92, and a sand return pipe 90. The sand within the sand dam assembly 72 is fluidized by fluidization nozzles 84.

Figure 19:
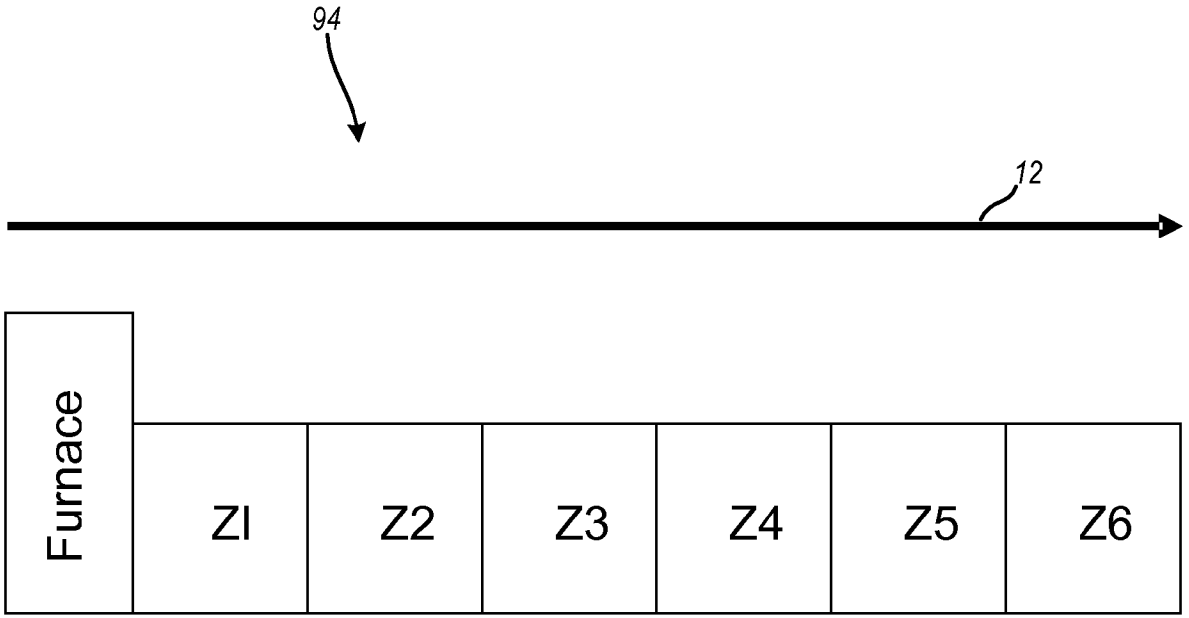
FIG. 19 is a schematic diagram of a modular air fluidized sand bed, illustrating, in particular, the furnace and six modular zones.

Referring now to FIG. 19, a schematic diagram of a six zone modular fluidized bed 94 is shown. Modular fluidized bed 94 includes six zones, Z1 through Z6. Wire path 12 illustrates the direction of wire flow through each of the six zones, Z1 through Z6.

Figure 20:
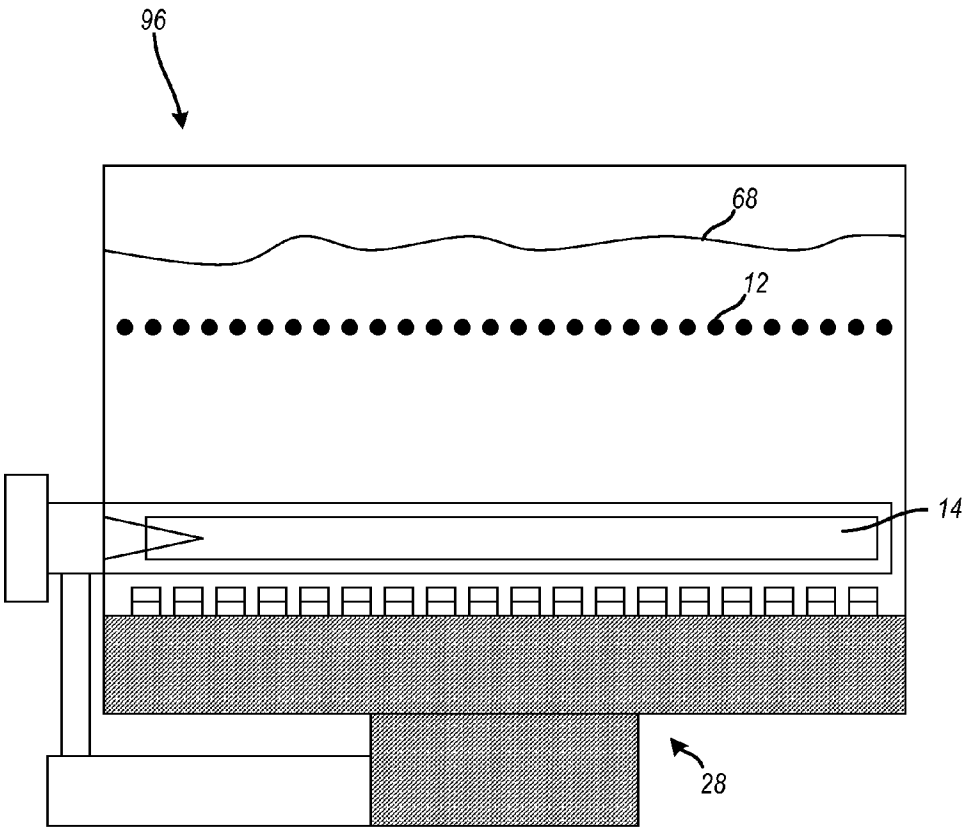
FIG. 20 is a schematic diagram of one fluidized bed module, illustrating, in particular, the burner, plenum, and sand.

Referring now to FIG. 20, a schematic diagram of one fluidized bed module 96 that can be utilized in one of the six zones of FIG. 19, illustrating, the burner 14, plenum 28, and sand level 68, is shown. To achieve sand level 68, approximately 300 to 350 cubic feet of sand, for example, can be utilized to fill one fluidized bed module 96. Wire path 12 illustrates the direction of wire flow through the one fluidized bed module 96 above the burners 14 and below the sand level 68. The flow pressure beneath the sand can be, for example, approximately 1.5 to 3 pounds per square inch (PSI) and at a flow rate of approximately 200 cubic feet per minute (CFM).

Figure 21:
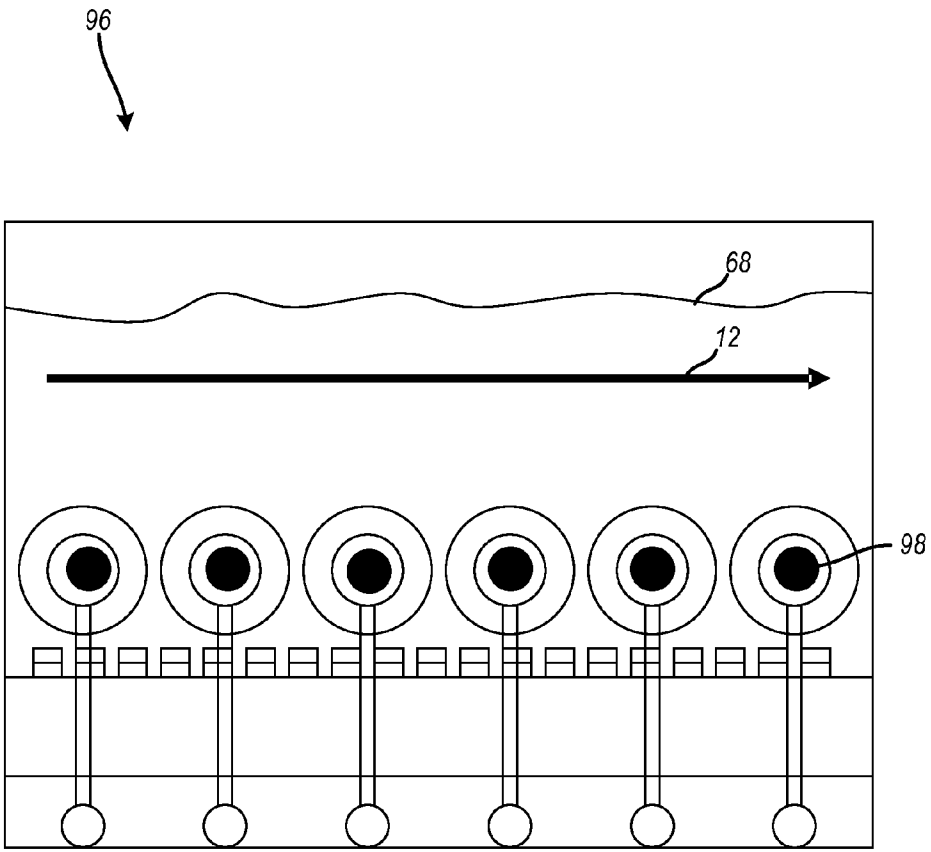
FIG. 21 is a schematic diagram of one fluidize bed module, illustrating, in particular, all burners firing in standby.
Figure 22:
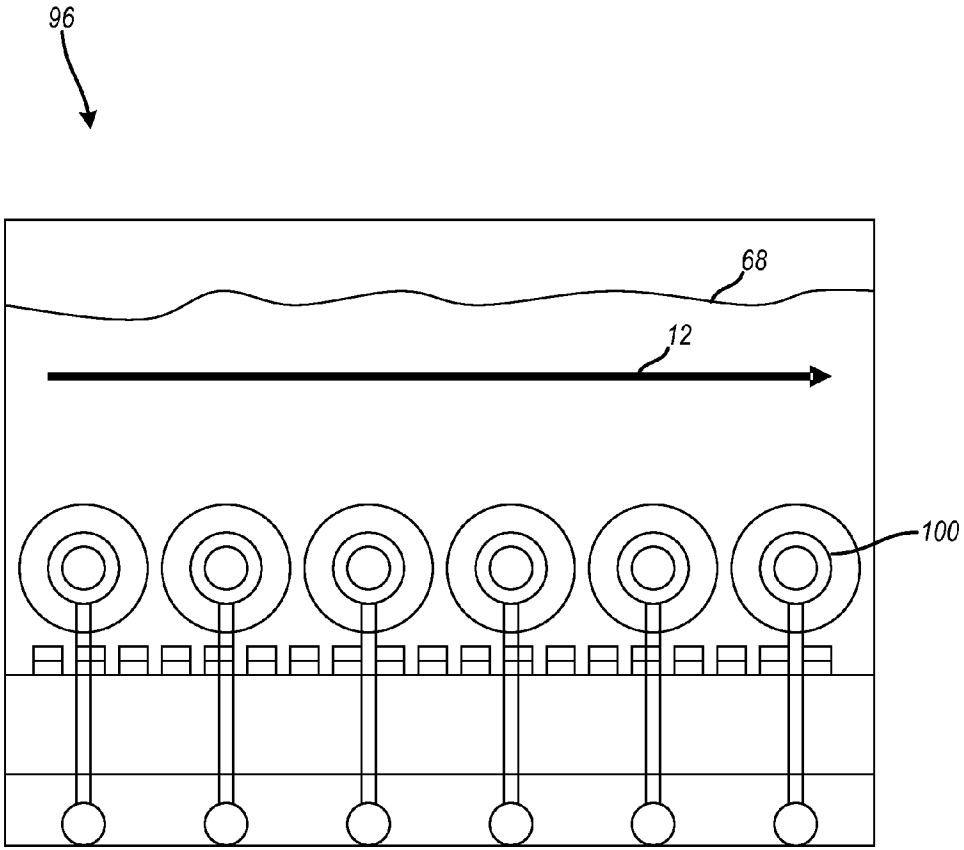
FIG. 22 is a schematic diagram of one fluidize bed module, illustrating, in particular, all burners in an off state.
Figure 23:
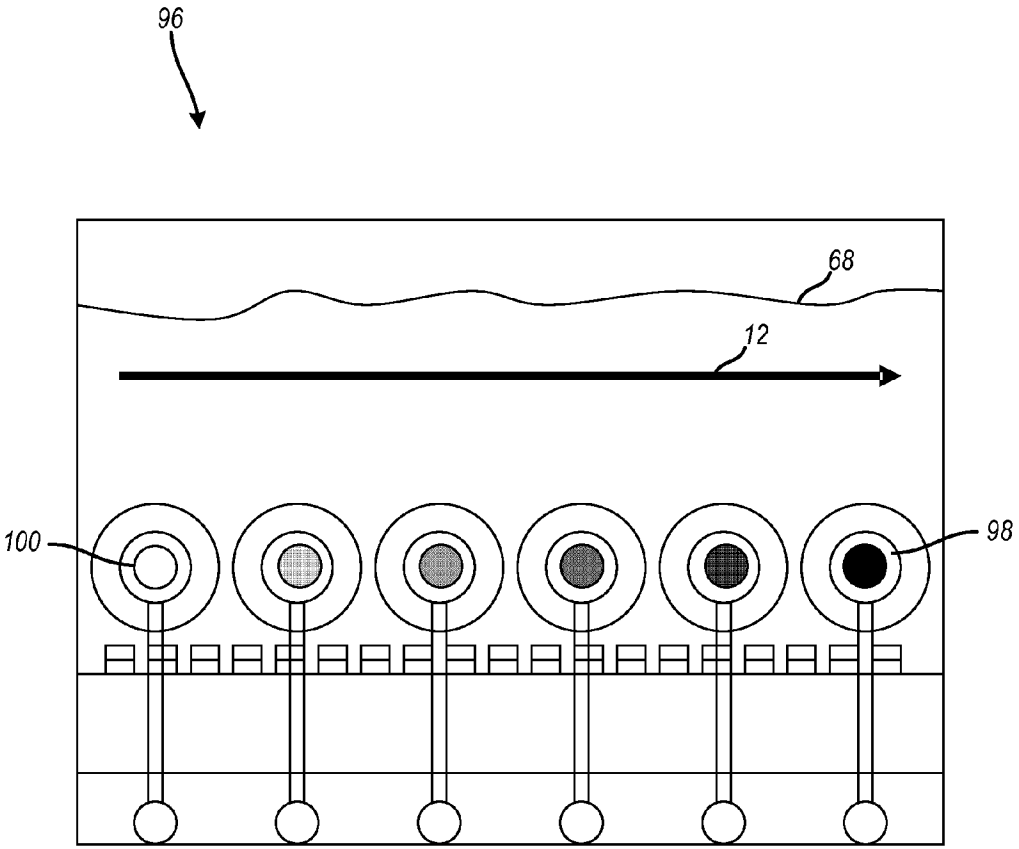
FIG. 23 is a schematic diagram of one fluidize bed module, illustrating, in particular, some burners firing in standby and some burners in an off state.

Referring now to FIGS. 21, 22, and 23, schematic diagrams of one fluidize bed module 96, illustrating burners in various states, are shown. As depicted in FIG. 21, one fluidize bed module 96 illustrates all burners firing in standby 98. As depicted in FIG. 22, one fluidize bed module 96 illustrates all burners in an off state 100. As depicted in FIG. 23, one fluidize bed module 96 illustrates some burners firing in standby 98 and some burners in an off state 100.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the disclosed technology and are intended to be covered by the following claims.

What is claimed is:

1. A modular air fluidized sand bed for the heat treatment of metal products, the modular air fluidized sand bed comprising:

a plurality of gas-fired burners directed into a plurality of U-tube assemblies in a fluidized-sand heat transfer media heated by a fluidizing agent and exhausted into a plenum of a modular air fluidized sand bed, the modular air fluidized sand bed having a fluidization pressure and a fluidization volume that selectively are altered independent of a fluidization media temperature;

an independent control module to alter temperature;

an independent control module to alter fluidization pressure; and an independent control module to alter fluidization volume;

wherein the modular air fluidized sand bed is comprised of a plurality of modules configured for assembly as the modular fluidized bed.

2. The modular air fluidized sand bed of claim 1, wherein the fluidizing agent is hot exhaust gas recovered from the plurality of U-tube assemblies.

3. The modular air fluidized sand bed of claim 1, wherein blended exhaust gases and cool air from a cool air source maintain fluidizing gas, plenum, and retort temperatures at generally a same temperature as the sand.

4. The modular air fluidized sand bed of claim 1, wherein a constant volume and pressure of fluidizing gas is utilized to maximize heat transfer between sand and a product being treated in the modular air fluidized sand bed.

5. The modular air fluidized sand bed of claim 1, further comprising:

a thermally insulated fluidization cover to be held in direct contact with the hot fluidized sand to improve the energy efficiency of the modular air fluidized sand bed.

6. The modular air fluidized sand bed of claim 1, further comprising:

a high-pressure air source to assist a start of a fluidization process when a fluidization media is cool.

7. The modular air fluidized sand bed of claim 1, further comprising:

an exhaust manifold assembly to capture and route exhaust from the heat units directed into a plurality of U-tube assemblies from the U-tube assemblies to one of into a retort above a sand level and through a hood.

8. The modular air fluidized sand bed of claim 7, wherein the exhaust manifold assembly further comprises:

a U-tube exhaust manifold; and a venting line disposed upon the U-tube exhaust manifold to vent the exhaust.

9. The modular air fluidized sand bed of claim 8, wherein the exhaust manifold assembly further comprises:

a first pressure transducer to control pressure in the U-tube exhaust manifold; and a valve controlled by the pressure transducer and configured to vent exhaust;

wherein an exhaust gas pressure in the U-tube exhaust manifold is held constant through utilization of the pressure transducer and valve.

10. The modular air fluidized sand bed of claim 8, wherein the exhaust manifold assembly further comprises:

a cool air manifold to contain cool air for blending with the U-tube exhaust manifold gas in order to reduce a temperature in the plenum.

11. The modular air fluidized sand bed of claim 10, wherein the exhaust manifold assembly further comprises:

a thermocouple disposed within the plenum to monitor and control temperature;

a first blending valve controlled by the thermocouple disposed within the plenum and configured to release gas from the U-tube exhaust manifold to blend with gas from the cool air manifold; and a second blending valve controlled by the thermocouple disposed within the plenum and configured to release gas from the cool air manifold to blend with gas from the U-tube exhaust manifold;

wherein it is desired to have the same temperature in the plenum as a temperature of the fluidized sand in the modular air fluidized sand bed.

12. The modular air fluidized sand bed of claim 11, wherein the exhaust manifold assembly further comprises:

a second pressure transducer disposed with the cool air manifold and configured to control pressure in the cool air manifold; and a third pressure transducer disposed with the plenum and configured to control pressure in the plenum;

wherein the pressure in the cool air manifold and the pressure in the exhaust manifold are maintained at the same pressure to facilitate blending.

13. The modular air fluidized sand bed of claim 1, further comprising:

a sand return assembly having fluidization nozzles to return sand lost from an exit of the modular air fluidized sand bed to an entrance of the modular air fluidized sand bed utilizing fluidization and gravity to move a fluidization media.

14. The modular air fluidized sand bed of claim 1, wherein the sand return assembly further comprises:

a sand dam assembly to contain sand for return in the sand return assembly;

a sand hopper assembly to maintain a sand level within the modular air fluidized sand bed;

a fluidization air supply; and a plurality of fluidization nozzles disposed on an underside of the sand hopper assembly and the sand dam assembly.

* * * * *